US010653228B2

(12) United States Patent
Faverio

(10) Patent No.: US 10,653,228 B2
(45) Date of Patent: May 19, 2020

(54) METHOD FOR MANUFACTURING COSMETIC PRODUCT CAPSULES, SPECIFICALLY LIPSTICKS, AND RELATING MANUFACTURING MACHINE

(71) Applicant: PATENT LAB SA., Chiasso (CH)

(72) Inventor: Sergio Faverio, Chiasso (CH)

(73) Assignee: PATENT LAB SA, Chiasso (CH)

( * ) Notice: Subject to any disclaimer, the term of this patent is extended or adjusted under 35 U.S.C. 154(b) by 396 days.

(21) Appl. No.: 15/118,195

(22) PCT Filed: Mar. 5, 2015

(86) PCT No.: PCT/IB2015/051610
§ 371 (c)(1),
(2) Date: Aug. 11, 2016

(87) PCT Pub. No.: WO2015/132750
PCT Pub. Date: Sep. 11, 2015

(65) Prior Publication Data

US 2017/0035183 A1 Feb. 9, 2017

(30) Foreign Application Priority Data

Mar. 6, 2014 (IT) ..... RM2014A0107

(51) Int. Cl.
*A45D 40/16* (2006.01)
*B65B 3/04* (2006.01)
(Continued)

(52) U.S. Cl.
CPC ..... *A45D 40/16* (2013.01); *B65B 3/04* (2013.01); *B65B 7/28* (2013.01); *B65B 51/10* (2013.01); *B65B 63/08* (2013.01)

(58) Field of Classification Search
CPC ..... A45D 34/00; A45D 34/06; A45D 40/16; A45D 40/22; B65B 63/08; B65B 3/04; B65B 7/28; B65B 51/10; B29C 45/14
(Continued)

(56) References Cited

U.S. PATENT DOCUMENTS 2,263,302 A * 11/1941 Johnson ..... B29C 67/00 425/117
3,054,679 A * 9/1962 Bradford ..... B65D 71/70 206/558
(Continued)

FOREIGN PATENT DOCUMENTS

EP 0 418 841 A1 3/1991
EP 1 813 335 A2 8/2007

OTHER PUBLICATIONS

International Search Report, dated Jul. 14, 2015, from corresponding PCT application.

*Primary Examiner* — Praachi M Pathak
(74) *Attorney, Agent, or Firm* — Young & Thompson

(57) ABSTRACT

Method and machine (10) for producing capsules of cosmetic products, preferably lipsticks. The method includes a step of introducing (2000) a base volume of a cosmetic product into a melting and preparing the machine to melt and prepare cosmetic products, and a subsequent step of injecting (2020) a predetermined and melted portion of the base volume of cosmetic product by injecting elements (160) of the machine (10) into a containment capsule (200) of the predetermined portion of the base volume of cosmetic product; the containment capsule and the predetermined portion of cosmetic product making up a semifinished product of the cosmetic product designed to be subjected to subsequent steps of working and morphological processing before its final use by an user.

9 Claims, 3 Drawing Sheets

(51) Int. Cl.
*B65B 7/28* (2006.01)
*B65B 51/10* (2006.01)
*B65B 63/08* (2006.01)

(58) Field of Classification Search
USPC ..... 53/440, 127, 471, 281; 264/259, 267, 264/268; 401/49–98
See application file for complete search history.

(56) References Cited

U.S. PATENT DOCUMENTS 3,837,778 A * 9/1974 Parker ..... B29C 39/00 206/524.7
4,172,113 A * 10/1979 Featherstone ..... A45D 40/16 264/319
4,200,481 A * 4/1980 Faller ..... B29C 51/165 156/285
4,409,252 A * 10/1983 Buschkens ..... B65B 31/043 426/316
4,748,796 A * 6/1988 Viel ..... B65B 1/04 156/245
4,750,312 A * 6/1988 de Vaujany ..... B65B 7/2807 53/307
4,755,245 A * 7/1988 Viel ..... B29C 37/0067 156/227
4,813,801 A * 3/1989 Cardia ..... A45D 40/06 206/385
4,995,408 A * 2/1991 Wallschlaeger ... A45D 40/0087 132/320
5,066,216 A * 11/1991 Kowtko ..... A45D 40/16 137/862
5,071,667 A * 12/1991 Grune ..... B65B 31/00 426/232
5,307,608 A * 5/1994 Muir ..... B65B 63/08 53/127
5,316,712 A * 5/1994 Ono ..... A45D 40/16 264/102
5,406,990 A * 4/1995 Haeberli ..... B65B 63/02 141/101
5,617,705 A * 4/1997 Sanfilippo ..... B65B 31/00 53/281
5,687,542 A * 11/1997 Lawecki ..... B29C 45/0084 264/232
5,799,667 A * 9/1998 Szekely ..... A45D 40/16 132/200
5,806,285 A * 9/1998 Rizzieri ..... B29C 66/87443 53/122
6,006,497 A * 12/1999 Waver ..... B65D 75/002 264/264
6,245,341 B1 * 6/2001 Pahlck ..... A45D 33/00 424/401
6,338,840 B1 * 1/2002 Allan ..... A45D 40/16 264/102
6,922,975 B1 * 8/2005 Shiraishi ..... A45D 33/00 53/246
7,093,816 B2 * 8/2006 Lacan ..... F25C 1/243 249/121
7,326,042 B2 * 2/2008 Alper ..... B65B 63/08 425/127
2002/0041788 A1 * 4/2002 Look ..... A45D 40/04 401/68
2005/0087562 A1 * 4/2005 Koide ..... B01F 5/0453 222/252
2006/0283727 A1 12/2006 Nelson et al.
2008/0143018 A1 * 6/2008 Lazzarini ..... A45D 40/16 264/259
2008/0213028 A1 * 9/2008 Hosokawa ..... A61K 8/02 401/88
2011/0135377 A1 * 6/2011 Teller ..... A45D 40/00 401/88
2011/0180445 A1 * 7/2011 Hurwitz ..... A61K 8/0216 206/461
2011/0268854 A1 * 11/2011 Jay ..... B65B 3/02 426/396
2012/0009135 A1 1/2012 Misner et al.
2014/0041340 A1 * 2/2014 Thomas ..... B65D 75/325 53/440
2015/0313345 A1 * 11/2015 Langmuir ..... A45D 40/16 264/237
2015/0367566 A1 * 12/2015 Schwab ..... B29C 66/21 53/453
2017/0258200 A1 * 9/2017 Rossi ..... A45D 40/16

* cited by examiner

METHOD FOR MANUFACTURING COSMETIC PRODUCT CAPSULES, SPECIFICALLY LIPSTICKS, AND RELATING MANUFACTURING MACHINE

TECHNICAL FIELD

The present invention relates to the cosmetic field and, in detail, concerns a machine for producing capsules of cosmetic products. The present invention also concerns a method for producing capsules of cosmetic products. In detail, such cosmetic products are lipsticks.

KNOWN ART

Referring particularly to cosmetic products such as lipsticks or lip glosses or even lip salves, it is known that they are currently produced according to a method briefly described hereinafter, particularly referring to FIG. 1. First of all a bulk, or base volume, of lipstick preparation produced according to predetermined technical specification based on a color set, is introduced (block 1000) into an opening or inlet of a lipstick preparing machine which primarily melts the afore said bulk (block 1010).

The bulk could be molten in a specific melter fluidically connected to the machine.

Subsequently, the molten bulk is injected through nozzle-like injecting means into a plastic sleeve or coating (block 1020), preferably made of silicone, having the final shape of the lipstick. The final shape of the lipstick tube is obtained by injecting the molten bulk into the plastic sleeve or coating. In detail, the inner surface of the plastic sleeve or coating is designed so as not to adhere to the bulk material, thereby allowing the bulk to be subsequently separated from the sleeve or coating without damaging the outer surface of the lipstick tube, which is required for aesthetic reasons to be free of surface damages.

In detail, the known machine is provided with a plurality of sleeves or coatings on a circular rotating surface within respective housings angularly spaced along a circumference; a new coating is placed step by step in front of the nozzle-like injecting means by the rotation (block 1030) of this circular surface.

The bulk injected within the sleeve or coating must then be cooled (block 1040); conversely, it would not be able to maintain the shape provided by the sleeve itself, and the process leading to create the commercially sold "lipstick" could not carry on.

At this point, mechanical gripping means grasp the rear part of the lipstick tube (block 1050) by extracting the tube itself from the sleeve or coating and introduce it into the final plastic support, the latter typically comprising a first portion, or cap, and a second portion or main body provided with a roto-translating support controlled by a rotating ring having, in turn, a plurality of helically arranged grooves in which respective pins of the roto-translating support are engaged; the lipstick tube is introduced on this support by mechanically countering (block 1060).

At the end of the latter step, the lipstick tube is subjected to a visual quality control (block 1070), that is manually made by human; if that quality control is positive, the lipstick can be led to the subsequent packaging steps, to a possible additional quality control step, and finally to the destination of the lipstick to the commercial market.

However, the producing technique hitherto described is characterized by some disadvantages. In particular the Applicant noticed that, on the one hand, the cost of the plastic support is part of the cost of the lipstick; in particular, the lower the cost of the product itself, i.e. the actual lipstick tube, the greater the percentage cost fraction of the support, preferably made of plastic. Often, in fact, medium or even medium-high quality lipsticks are substantially inaccessible or not purchased by the average public because of their retail cost largely due to primary and secondary packaging.

Furthermore, the Applicant noticed that the disposal of the lipstick support, preferably made of plastic, at the end of the use is not environmentally friendly: in fact, it is typically made of materials, or coated with paints or other coatings, which are not biodegradable.

Furthermore, the Applicant has found that there is an excessive waste of not used products, such as lipsticks and lip glosses, with their packaging with respect to those actually required by the market.

Nevertheless, the Applicant has observed that the quality control performed by the human being is slow and expensive, as well as not always reliable. However, such quality control has a substantial impact on productive costs of the lipstick.

Finally, the current producing methods and machines are not able to substantially reduce the working times of the machine itself.

Therefore, the Applicant conceived a producing machine for capsules of lipstick able to solve the above described drawbacks.

Similarly, therefore, the Applicant conceived a method for producing capsules of lipstick able to solve the above described drawbacks.

SUMMARY OF THE INVENTION

According to the present invention a method for producing capsules of cosmetic products, preferably lipsticks, is obtained, said method comprising the steps of:

introducing a base volume of a cosmetic product into a melting and preparing machine to melt and prepare cosmetic products, providing at least one containment capsule, comprising at least one open cavity adapted to contain a predetermined amount of cosmetic product of less than 20 g and provided with at least one thermally conductive portion;

melting at least one portion of said base volume of the cosmetic product;

injecting said predetermined amount of said molten cosmetic product into said containment capsule;

sealing said containment capsule (200) containing said predetermined amount of cosmetic product; said containment capsule (200) and said predetermined amount of cosmetic product making up a semifinished product of said final cosmetic product adapted to be used by a user;

said semifinished product being intended to undergo subsequent steps of working and shape transformation in order to become a final cosmetic product, before being finally used by a user.

Advantageously, the sealing step comprises a step of sealing the cavity of said capsule by a lid or tongue operating to isolate said predetermined amount of cosmetic product.

Preferably, the method further comprises a step of introducing at least one empty containment capsule into an orifice or container of the melting and preparing machine.

Conveniently, the method further comprises a step of extracting said containment capsule filled with the predetermined amount of cosmetic product from the machine.

Preferably, a base volume of cosmetic product comprises a mixture of oils, waxes and pellets of colored or pigmented and/or pearlizing material mixed with a base composition having homogeneous consistency; said base composition further comprising at least one of the following excipients: gloss modifiers, wetting agents or humectants, vitamins, fruit extracts, sunscreens, as well as conserving agents such as preservatives and/or antioxidants.

According to the present invention, it is further implemented a machine for producing capsules of cosmetic products; such a machine comprises a container configured for containing a base volume of a cosmetic product and melting means to melt said base volume of said cosmetic product; said machine comprising a container for said base volume of said cosmetic product and injecting means configured to inject a predetermined portion of said volume base of cosmetic product into said containment capsule, said capsules being able to comprise a predetermined portion of said base volume of cosmetic product and making up a semifinished cosmetic product able to receive additional working steps before use.

Advantageously, such a machine is configured to carry out a plurality of injection cycles of said predetermined portion of base volume of cosmetic product in a sequential and predetermined way.

Advantageously, every injection cycle comprises an injection of a mass of cosmetic product lower than, or equal to, 20 g.

Advantageously, the machine further comprises a sealing stage of said containment capsule.

Advantageously, said machine is designed so that said sealing stage of said containment capsule occurs downstream of said injection.

Advantageously, said sealing stage occurs a predetermined time after said injection.

Advantageously, said sealing stage comprises heat-sealing means.

Advantageously, said sealing stage of said containment capsule takes place under controlled atmosphere inside a container designed so as to prevent macrocontaminants from entering into said capsule.

Advantageously, said sealing stage comprises a container for a plurality of tongues which are able to be applied on an opening of said capsule and handling means configured for picking up a tongue at a time from said container and positioning it at said opening of said capsule.

Advantageously, the machine object of the present invention comprises handling means to handle said at least one capsule between said injecting means and said sealing stage through an at least partially linear translation and/or a rotation.

DESCRIPTION OF THE ATTACHED FIGURES

In the present description, the Applicant illustrates a preferred, non-limiting embodiment of the invention, by referring to the appended figures, wherein.

DETAILED DESCRIPTION OF THE INVENTION

Figure 1:
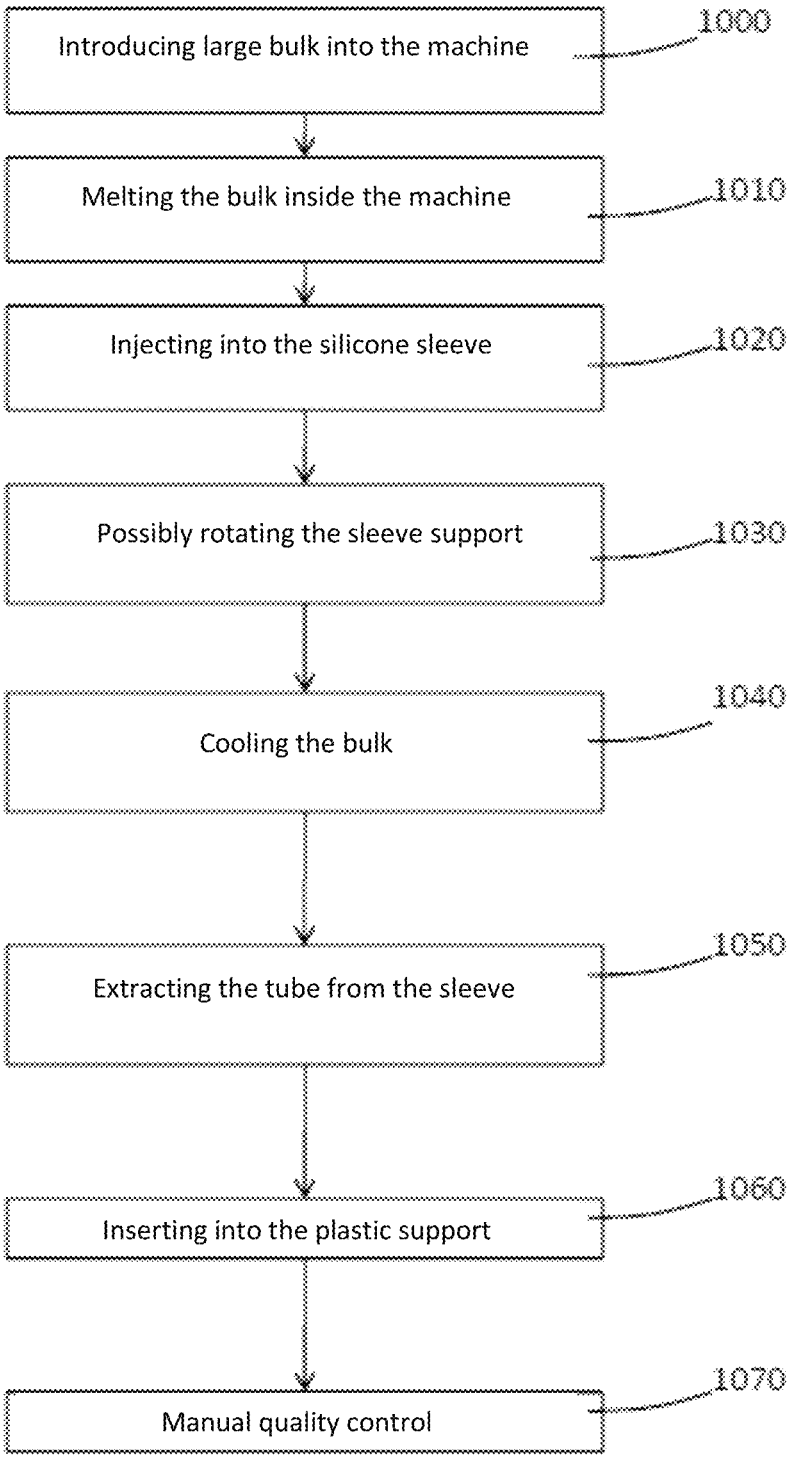
FIG. 1 is a block diagram of a producing process of known lipsticks.
Figure 2:
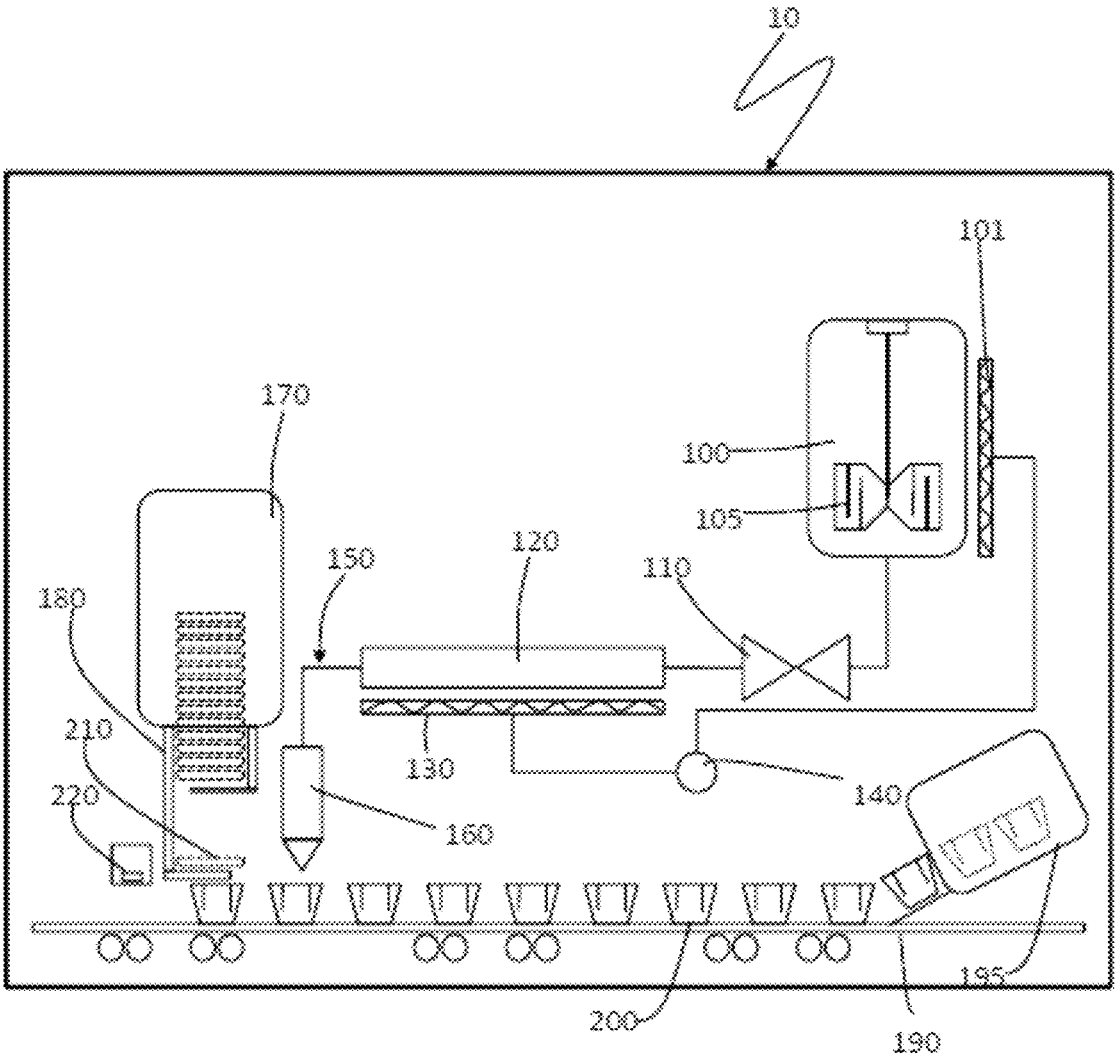
FIG. 2 is a schematic illustration of a machine for producing capsules of cosmetic products according to the present invention.
Figure 3:
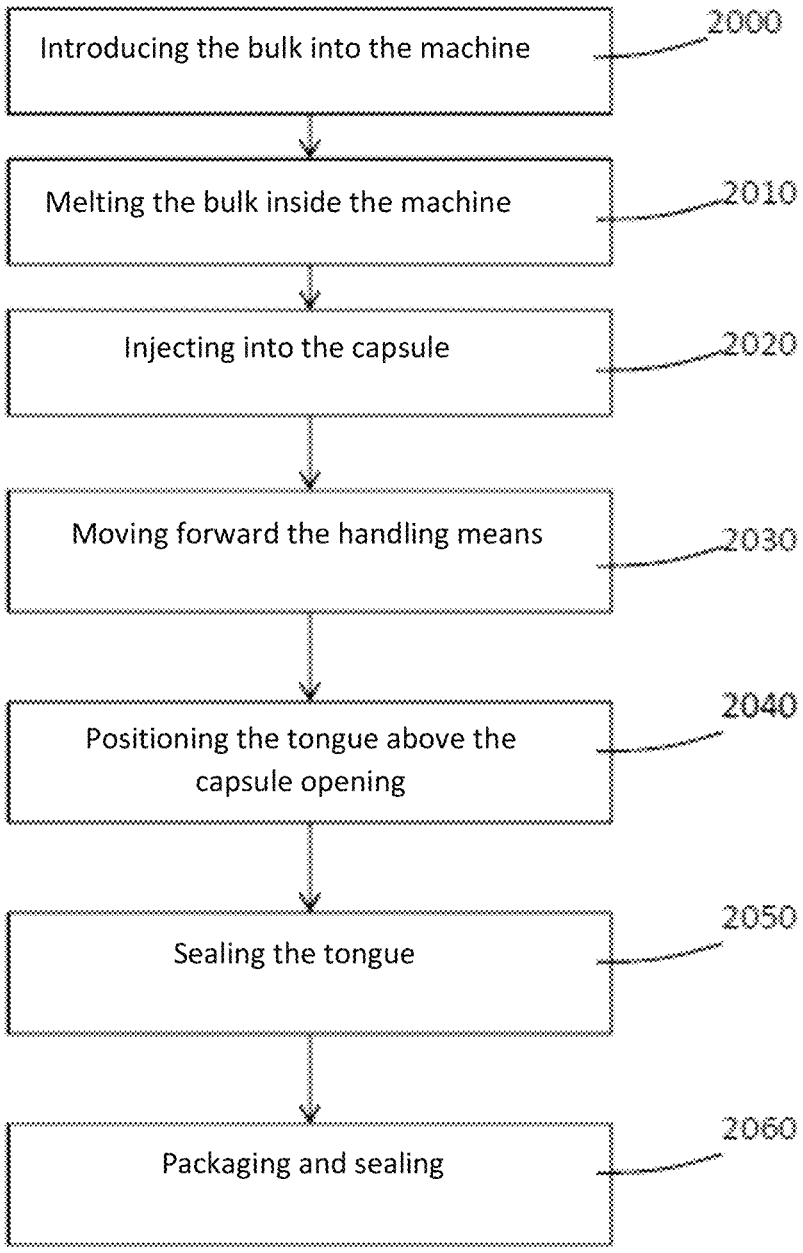
FIG. 3 is a flow diagram of a producing process of capsules of cosmetic products according to the present invention.

Referring to FIGS. 2 and 3, the present invention describes a producing machine and a method thereof to produce capsules of cosmetic products, preferably lipsticks. Therefore, by way of example and without restrictive intent, the present description will address to the description of a machine and a process in which the cosmetic product is a lipstick.

In detail, the machine comprises a first vessel 100 where a base volume of a cosmetic product, in particular a lipstick, is poured in, being in detail produced in compliance with color, texture and predetermined material specifications (this operation corresponds to the block 2000 of the block diagram of FIG. 3). Preferably, the bulk or base volume is produced from a mixture of oils, waxes and/or colored (pigmented) and/or pearlizing material mixed together so as to form a base compound having a homogeneous consistency. The base compound can be further characterized by gloss or texture modifiers, wetting agents or humectants, vitamins, fruit extracts, sunscreens, as well as conserving agents, such as preservatives and/or antioxidants.

Also, the bulk or base volume can comprise several pigments, active ingredients or pearls.

The first vessel can be enclosed within first heating means 101 which allow maintaining the basic compound to a temperature suitable to carry out the rest of the process described hereinafter.

Optionally stirring means 105, able to keep the base preparation moving inside the vessel so as to advantageously keep unchanged its homogeneity, can be provided inside the first vessel.

A feed line, feeding an additional heating container 120 through a flow control valve 110 of a known type, extends from the first container or vessel. The additional heating container 120 is heated by second heating means 130, although preferably not limited to the electric type, supplied by a supplying source 140 which can be, in use, the same supplying the first heating means. A melting action of the base preparation of the cosmetic product is carried out and/or maintained by the first and second heating means (this operation corresponds to the block 2010 of the block diagram of FIG. 3).

The first and/or second heating means are preferably intended, although not exclusively, to lead the base preparation up to a temperature of about 100° C., or anyway a temperature able to prevent the cosmetic product from solidifying, even partially, because this may cause the homogeneity of the preparation to be damaged or the feed line of the herein described machine to become blocked or clogged, either alternatively or in combination one with the other.

The feed line extends from an additional heating container 120 with a duct 150 feeding at least one dispensing nozzle or head 160 which is configured to allow a sub-portion of the base volume of lipstick preparation to be injected into one or more containment capsules 200 of semifinished cosmetic products. The injection operation corresponds to the block 2020 of the block diagram of FIG. 3.

The capsules 200 are positioned below the dispensing nozzle or head 160 by handling means advantageously comprising a conveyor belt 190, and they come from a capsule dispenser 195 designed so as to collect a plurality of capsules queuing up or forming a line in order to arrange them neatly on the conveyor belt by known handling means. The conveyor belt 190 in mechanically connected with an actuator comprising either a continuous feed motor or a stepper motor designed so as to be able to move forward said conveyor belt 190 forward of a predetermined length at each cycle (this operation corresponds to the block 2030 of the block diagram of FIG. 3).

Clearly, the conveyor belt of the present invention must not necessarily be present; it can be replaced by equivalent handling means of the capsules, if theoretically equivalent, such as a rotating disc on which the capsule is rested or introduced in a supporting recess and moved from here to the sealing stage that will be better described in the following description.

Each capsule 200 comprises a body shaped as a cup or bowl, i.e. delimited by one or more side walls (depending on the fact that the plan section of the capsule is defined by a continuous or broken line) and by a base portion; the base portion and the side wall define an inner cavity or inner volume of the capsule and an upper opening allowing the cosmetic product to be introduced. The capsule 200 is made of one or more layers of material, so that the inner surface is able to hold a cosmetic product without significantly altering its properties, and in particular it is designed to hold a cosmetic product greatly heated with respect to the room temperature, without being damaged. In particular, the capsule 200 does not take the final form of the lipstick tube, typically having an use end obliquely cut on one side or on both sides, and its inner surface roughness or shape do not correspond to the negative of the final shape of the lipstick when ready to be used. Therefore, advantageously, the inner finishing of the capsule 200 can also be of mediocre quality with respect to that required in the silicone sleeve of the known art, thus bringing many advantages to the production economy of the capsule itself.

The capsule 200 is provided with at least one thermally conductive, i.e. not insulating, portion. Preferably the containment capsule 200 is provided with an aluminum portion, preferably the containment capsule is provided with at least the base portion and the side wall made of aluminum.

Alternatively, the base portion and the side wall of the containment capsule could be made of a thermally conductive plastic material, without departing from the protection scope of the present invention.

In detail a data processing unit, electrically connected with the flow control valve 110 and/or with opening/closing means to pen/close said dispensing nozzle or head 160, advantageously allows adjusting the feed flow of the base preparation into the capsule 200 according to an intermittent feeding cycle, in which times and doses are adjusted according to a predetermined criterion modifiable by the user also depending on the feed speed of the conveyor belt. Advantageously, the operating speed of the machine and particularly also the feed speed of the conveyor belt, can be set by user interface means of known type and electrically connected with said data processing unit. By slowing the feed speed of the conveyor belt and therefore increasing the time between the filling of the capsule 200 and the subsequent sealing thereof, the cosmetic product can partially solidify or anyway increase its viscosity before being sealed.

In detail, each capsule being designed to enable a lipstick tube to be obtained at a later time, for each filling cycle of the capsule 200, the nozzle or dispensing head dispenses an amount of cosmetic product less than or equal to about 20 g, so that the amount of wasted product in the subsequent preparation of the lipstick tube is minimal.

The cosmetic product, once introduced into the capsule 200, tends to cool by itself, and is not strictly necessary to provide the machine with cooling means in order to allow the content of the capsule to rapidly solidify.

Therefore, the cosmetic product introduced into the capsule 200 is a semifinished product and is not intended to be directly used by the users. In the case of lipstick, in fact, the capsule 200 is not shaped to allow the user to use the lipstick, and would not even be able to provide a semifinished product that meets the quality and aesthetic requirements which are traditionally associated with the lipstick tube sold in stores.

After the injecting step, the conveyor belt carries the filled capsules 200 below a sealing station or stage 170, 180, 220 comprising a vessel 170 containing a plurality of sealing tongues 210 for the capsules 200. In detail, the size of the sealing tongues is at least equal to the opening of the capsule 200.

Furthermore, handling means 180 of said tongues, designed to pick up a tongue at a time from said vessel 170 and place it above an upper opening of said capsule 200, are provided (this operation corresponds to the block 2040 of the block diagram of FIG. 3) so as to allow the tongue to be firmly sealed on the capsule body during the sealing stage 220. The inside environment of the capsule is therefore hermetically insulated from the outside environment in order to allow the cosmetic semifinished product to be conveniently preserved for a long time under suitable preserving conditions. Although in the attached figures the sealing stage is shown as separated from the handling means, this illustration is not to be considered as restrictive because it is actually possible to provide for the use of integrated handling and sealing means.

The sealing stage 220 performs a heat sealing operation of the tongue on the capsule body which is performed, more specifically, along a closed perimeter (block 2050 of the block diagram of FIG. 3).

Optionally, starting from the nozzle 160 towards the welding station 220, the operation of filling, of positioning the tongue over the opening of the capsule 200 and the sealing of the tongue itself can take place under controlled environmental conditions, in order to ensure the absence of macro-contaminants within the capsule. Advantageously, in this case the machine object of the present invention will comprise an envelope for at least part of its components in order to obtain the afore said controlled atmosphere.

The so-made capsules are then moved towards a storage warehouse where they are packed in cardboard boxes or else packages able to hold a plurality of capsules and then shipped to the retail distribution network (this operation corresponds to the block 2060 of the block diagram of FIG. 3).

In light of the foregoing description, the advantages given by the hitherto described method and machine are clear. In particular, the present invention provides the public with a semifinished lipstick which is contained in a simple pod or capsule rather than in an expensive packaging, thereby cutting the selling cost due to the packaging itself, i.e. the plastic support for the lipstick tube.

The transformation of the lipstick capsule into a ready-to-use product will then be carried out by the user. Therefore, the plastic or metal support of the lipstick tube, once purchased, can be reused. Moreover, the lipstick capsule or pod can be made of a biodegradable material and should not meet the requirements of the highest non-adherence to the product that must be met by the silicone sleeve of known type, since the capsule or pod should not define the shape of a final product but, instead, is only intended to contain—under the best possible preserving conditions—the semifinished product until the time when it will be molten.

The cooling step of the bulk is no longer of primary importance since once introduced in the capsule, it is sufficient to provide for the sealing of the latter to have a guarantee of integrity of the product, letting the bulk contained therein to cool by itself.

The machine and method object of the present invention allow the environmental pollution to be reduced because, when the lipstick tube has been used up, the user no longer has to throw the plastic support but will only have to melt the bulk lipstick contained in the capsule.

Further, the ability of selling capsules containing a small amount of lipstick allows the lipstick producing company to put on the market even lipsticks with colors or materials not widely purchased, or otherwise special, in a more cost-effective way. This also means greater choice for end users, who can more easily find particular colors of lipstick in retail cosmetic stores, colors that otherwise would not be convenient to be purchased by the store itself, which would be in danger of having a large amount of lipstick of particular colors prone to remain unsold and a substantial investment due in large part to the cost of the plastic support.

Finally, through the method described hitherto, an aesthetic quality assessment of the future lipstick tube is a task that can be left to the end user; in other words, the method and the machine of the present invention should not take into account, tout court, a quality control of the shape of the semifinished product.

Lastly, it is evident that variations, additions and modifications obvious for a person skilled of the art can be applied to the method and machine object of the present invention, without thereby departing from the protection scope provided by the enclosed claims.

The invention claimed is:

1. A method for producing cosmetic products in a plurality of containment capsules transformable into a support of a lipstick tube, said method comprising the steps of:

introducing (2000) a base volume of a cosmetic product into a melting and preparing machine, the cosmetic product being lipstick;

a melting step of melting the base volume of the cosmetic product in the melting and preparing machine to thereby form melted cosmetic product within the melting and preparing machine;

an injecting step of successively injecting a predetermined portion of the melted cosmetic product from the melting and preparing machine into a cavity of each containment capsule (200), each containment capsule (200) comprising a base portion delimited by a side wall that defines the cavity, the cavity of each containment capsule (200) sized to contain the predetermined portion of the melted cosmetic product, being less than 20 g, at least one of the base portion and the side wall of each containment capsule (200) comprising a thermally conductive material; and a sealing step of successively moving each containment capsule (200) to a sealing machine, and sealing an opening of the cavity of each containment capsule (200) containing said predetermined portion of the melted cosmetic product by removing a sealing tongue (210), one at a time, from the sealing machine and sealing the opening of the cavity with the removed sealing tongue (210) to hermetically insulate said predetermined portion of the melted cosmetic product within each containment capsule (200) from an outside environment, wherein after the sealing step, the predetermined portion of the melted cosmetic product within each containment capsule is a semifinished lipstick product sealed within each containment capsule, wherein after said sealing step, the semifinished lipstick product sealed within each containment capsule is worked and shape transformed by a user heating the containment capsule to heat the semifinished lipstick product contained within the containment capsule so that the thus-heated semifinished lipstick product contained within the containment capsule is moved into the support of the lipstick tube, the support being one of a plastic support or a metal support.

2. The method according to claim 1, wherein said sealing tongue is a lid (210).

3. The method according to claim 1, further comprising a step of introducing at least one empty containment capsule (200) into an orifice (195) of said melting and preparing machine.

4. The method according to claim 3, further comprising a step of extracting each said containment capsule (200) filled with said predetermined portion of the melted cosmetic product from said melting and preparing machine.

5. The method according to claim 1, wherein said sealing step occurs a predetermined time after said injecting step.

6. The method of claim 1, wherein the thermally conductive material is thermally conductive plastic material and both the base portion and the side wall of each containment capsule (200) are comprised of the thermally conductive plastic material.

7. The method of claim 1, wherein both the base portion and the side wall of each containment capsule (200) are comprised of the thermally conductive material.

8. The method of claim 1, wherein the thermally conductive material is aluminum and both the base portion and the side wall of each containment capsule (200) are made of aluminum.

9. The method of claim 1, wherein the support is a metal support.

* * * * *